US006311729B1

(12) United States Patent
Cox et al.

(10) Patent No.: US 6,311,729 B1
(45) Date of Patent: Nov. 6, 2001

(54) KITCHEN FAUCET SPOUT RETAINER

(75) Inventors: Jeffrey B. Cox; Charles A. McCormick; Edward A. Nasser, all of New Bern, NC (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/556,447

(22) Filed: Apr. 24, 2000

(51) Int. Cl.[7] ..... E03C 1/02
(52) U.S. Cl. ..... 137/801; 4/678
(58) Field of Search ..... 137/801, 615; 4/678

(56) References Cited

U.S. PATENT DOCUMENTS

| | | | | |
|---|---|---|---|---|
| 4,592,388 | | 6/1986 | Wilcox . | |
| 4,606,372 | * | 8/1986 | Hayman | 137/315 |
| 4,976,287 | | 12/1990 | Sheen . | |
| 4,998,555 | * | 3/1991 | Barhydt, Sr. et al. | 137/615 X |
| 5,301,715 | | 4/1994 | Becker . | |
| 5,381,830 | | 1/1995 | Niemann et al. . | |
| 5,458,154 | | 10/1995 | Niemann et al. . | |
| 5,464,045 | | 11/1995 | Niemann et al. . | |
| 5,715,868 | | 2/1998 | Ching et al. . | |
| 5,829,468 | | 11/1998 | Watanabe et al. . | |
| 5,873,387 | | 2/1999 | Weber et al. . | |
| 6,079,447 | * | 6/2000 | Holzheimer et al. | 137/801 |

* cited by examiner

*Primary Examiner*—Kevin Lee
(74) *Attorney, Agent, or Firm*—Cook, Alex, McFarron, Manzo, Cummings & Mehler, Ltd.

(57) ABSTRACT

A faucet spout assembly includes a centerbody, a spout hub with an outwardly extending spout and a retainer located therebetween to limit rotational movement of the spout hub on the centerbody and more specifically to limit the rotational movement of the spout to a range defined by the open area of the sink. The centerbody includes a recess which receives an inward projection of the retainer and limits rotational movement thereof relative to the centerbody. The spout hub includes a cavity with an arcuate recess which receives a retainer outward projection. The length of the arcuate recess is preferably sized to limit the rotational movement of the spout to the open area of the sink. The centerbody includes an annular groove which receives a ledge of the retainer to assist in retainer positioning around the centerbody.

6 Claims, 2 Drawing Sheets

Fig. 3.
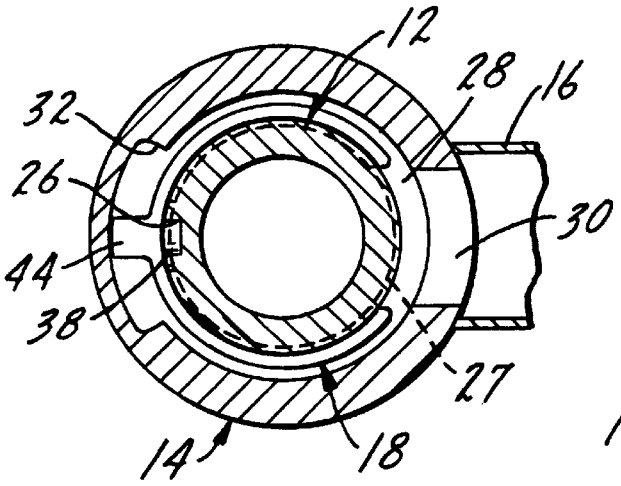
Fig. 4.
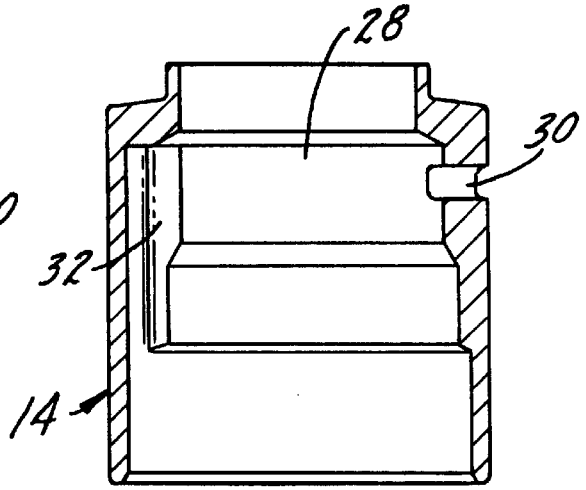
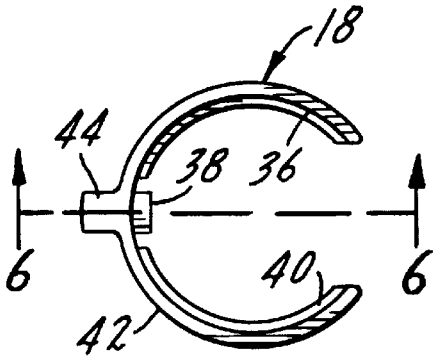
Fig. 5.
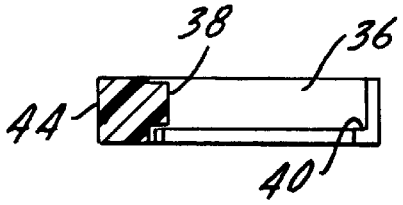
Fig. 6.

KITCHEN FAUCET SPOUT RETAINER

FIELD OF THE INVENTION

This invention relates to faucet spouts, particularly kitchen faucet spouts, and specifically relates to spouts which have limited rotational movement. By limiting rotational movement of the spout, the user will not be able to rotate the spout outside of the range of the sink. This is important to the user because the water from the spout will always be directed toward the sink so that less clean up is required adjacent the sink. The present invention provides a kitchen faucet spout retainer which limits rotational movement of the faucet spout and prevents the spout from rotating outside of the range of the sink.

SUMMARY OF THE INVENTION

The present invention relates to a faucet spout retainer particularly for kitchen faucets which limits the rotational movement of the faucet spout and specifically limits the rotational movement of the faucet spout within a range defined by the open area of the sink.

A primary purpose of the invention is to provide a faucet spout assembly which includes a retainer positioned between the spout hub and the centerbody, and which the retainer restrains rotational movement of the spout.

Another purpose of the invention is to provide a faucet spout which has a range of rotational movement limited to the open area of the sink.

Another purpose is a spout retainer as described which will shear at a calculated force to prevent possible faucet damage.

Other purposes will appear in the ensuing specification, drawings and claims.

BRIEF DESCRIPTION OF THE DRAWINGS

The invention is illustrated diagrammatically in the following drawings wherein:

FIG. 3 is a section along line 3—3 of FIG. 1;

FIG. 4 is a section of a spout hub;

FIG. 5 is a plan view of a retainer; and

FIG. 6 is a section along line 6—6 of FIG. 5.

DETAILED DESCRIPTION OF THE PREFERRED EMBODIMENT

Current faucet spouts, particularly kitchen faucet spouts, may have the ability to rotate as desired by the user. While rotational movement is generally advantageous, the spout may also be rotated outside of the sink range. This has been perceived by the user as an imperfection. If the spout is rotated outside of the sink range during use, then water from the spout may flow to areas adjacent to the sink and require additional cleaning time by the user. The present invention is specifically directed to a restraint on the rotational movement of the spout such that the user cannot rotate the spout outside of a sink range. It further provides for restraint failure at a specified force to prevent possible spout damage.

Figure 1:
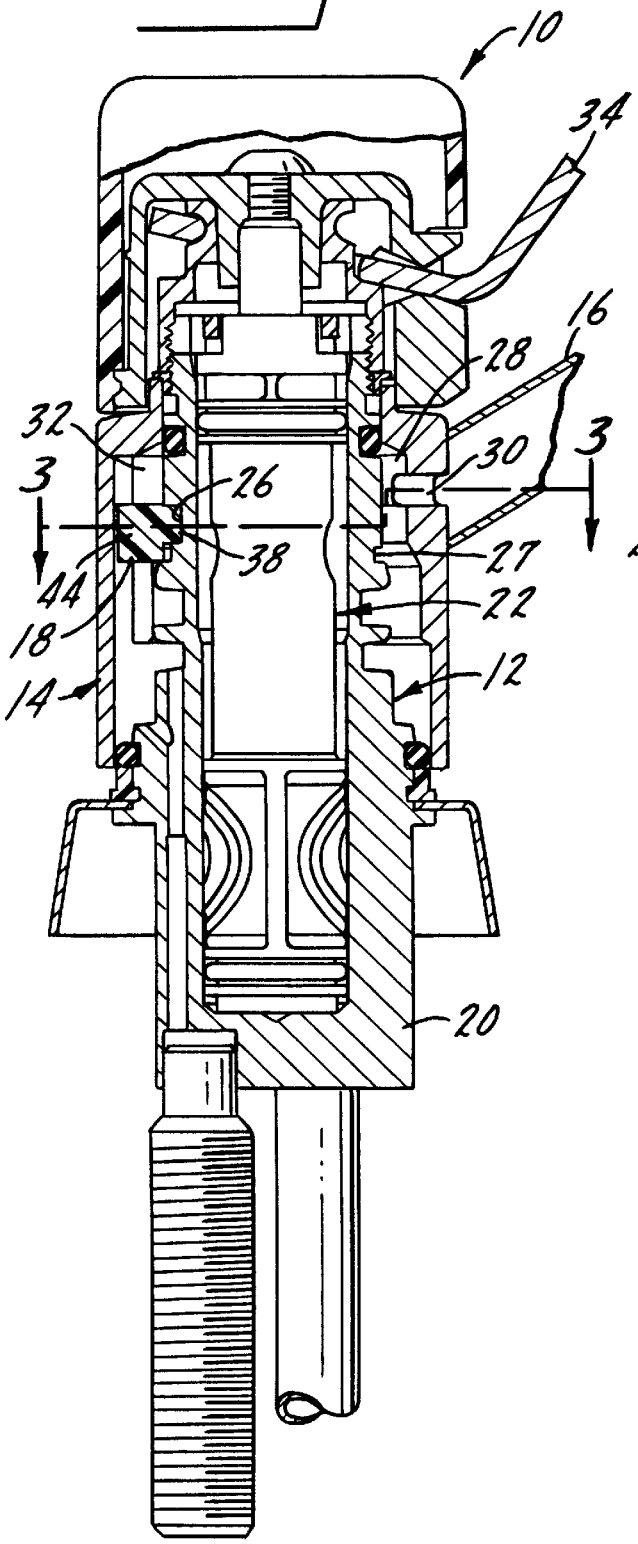
FIG. 1 is a section of a faucet spout assembly with some parts shown in solid.
Figure 2:
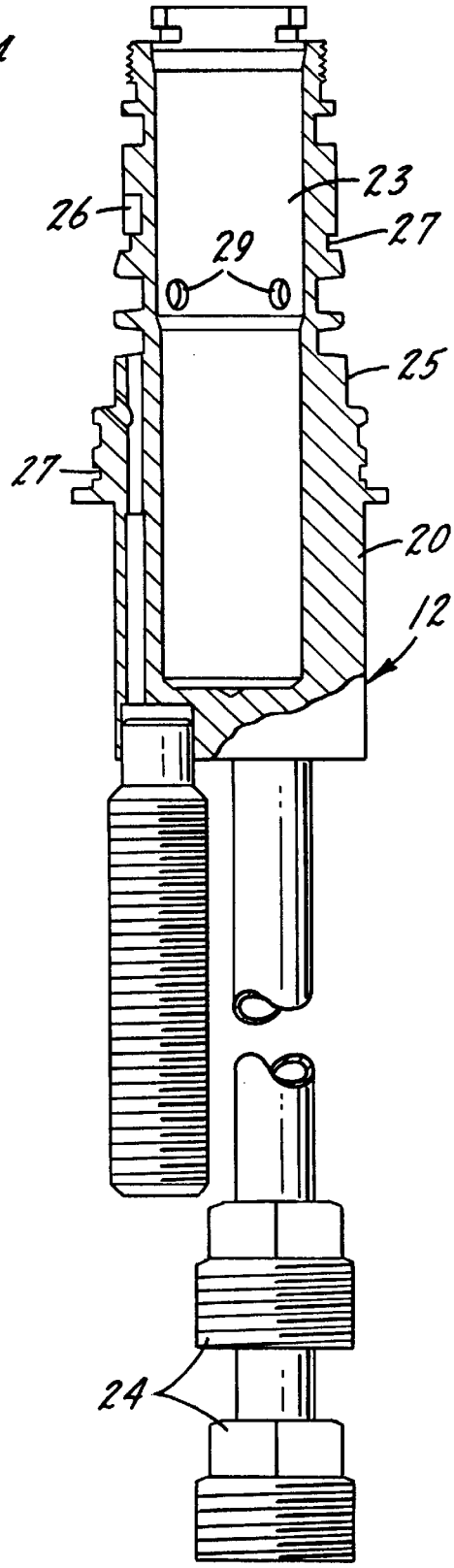
FIG. 2 is an axial section of a valve body.

In FIG. 1, a faucet spout assembly 10 includes a centerbody 12, a spout hub 14 with an outwardly extending spout 16 and a retainer 18. The centerbody 12 includes a valve body 20, as shown in FIG. 2, and a valve mixing cartridge assembly 22 positioned therein. The cartridge may be of the type sold by Moen, Incorporated, assignee herein, under the trademark 1225. The centerbody 12 has an internal water chamber 23 which is in fluid communication with hot water and cold water inlet ports 24. The exterior surface 25 of the centerbody 12 includes a recess 26 adjacent an annular groove 27 and has outlet ports 29. The spout hub 14 is positioned around the centerbody 12 in fluid communication with the chamber 23 through ports 29 and generally includes a cavity 28 and a hub outlet port 30. As shown in FIGS. 3 and 4, the cavity 28 includes an arcuate recess 32 formed on the internal surface thereof. The hub outlet port 30 provides a fluid communication between the centerbody 12 and the spout 16 when the valve cartridge 22 is rotated and reciprocated by handle 34.

Positioned between the centerbody 12 and the spout hub 14, there is the retainer 18. Although other shapes are also possible, the retainer 18 is generally U-shaped and fits snugly around a substantial portion of the centerbody 12. The retainer 18 includes an internal surface 36 with an inwardly directed projection 38 and a ledge 40 located thereon. The external surface 42 of the retainer has an outwardly directed projection 44 located thereon. Although the projections 38, 44 are shown at the same circumferential position on the retainer 18 and on opposite sides thereof, resulting in a symmetrical retainer shape, the projections may be independently located at any position along the retainer such that non-symmetrical retainer shapes are possible. The ledge 40 is located along a substantial circumferential length of the retainer 18 and is received by the centerbody annular groove 27 to assist in positioning the retainer on the centerbody 12.

During assembly the retainer 18 is positioned on the centerbody 12 and the centerbody recess 26 securely receives the inward projection 38. The centerbody recess 26 thus secures the retainer and prevents retainer rotational movement relative thereto. As the spout hub 14 is positioned around the centerbody 12 and the retainer 18, the arcuate recess 32 receives the outward projection 44. The arcuate extent of the recess 32 will determine the range of rotational movement of the spout hub 14 relative to the retainer outward projection 44 with the projection 44 acting as a stop at either edge of the arcuate recess 32. The arc length of the recess 32 is preferably sized to limit the spout to rotation to a range defined by the open area of the sink.

During use of the assembly 10, the user may rotate the spout 16 as desired. As the spout rotates, the spout hub arcuate recess 32 rotates in either direction along its length until one edge thereof is stopped by the retainer outward projection 44. Once stopped, the spout is prevented from rotating further with the preferred spout swing area being defined by the sink open area. Thus, the spout is restrained from rotating outside of the sink range and any water from the spout will be directed within the sink. During spout rotation, movement of the retainer 18 is prevented by the connection between the retainer inward projection 38 and the centerbody recess 26. Failure of the retainer is designed to occur at a calculable stress load to prevent possible damage to the faucet components by excessive rotational force. If failure occurs, the retainer may easily be removed from the assembly and replaced.

Whereas the preferred form of the invention has been shown and described herein, it should be realized that there may be many modifications, substitutions and alterations thereto.

What is claimed is:

1. A faucet spout assembly including:

a centerbody having a recess located on the outside surface thereof;

a spout hub positioned around the centerbody and being rotatable thereto, said spout hub having a cavity with an arcuate recess facing the centerbody recess; and a retainer positioned between the centerbody and the spout hub and having an internal surface and an external surface, the internal surface being adjacent the centerbody and having an inward projection located thereon, the external surface being adjacent the spout hub and having an outward projection located thereon, the retainer inward projection being positioned in the centerbody recess to prevent rotational movement of the retainer relative to the centerbody and the retainer outward projection being positioned in the spout hub arcuate recess to limit rotational movement of the spout hub relative to the centerbody.

2. The faucet spout assembly of claim 1 wherein the spout hub arcuate recess has a predetermined length to prevent rotational movement of a spout of the assembly outside of an open sink area.

3. The faucet spout assembly of claim 1 wherein the retainer is primarily U-shaped.

4. The faucet spout assembly of claim 1 wherein the retainer inward projection is located on the retainer directly opposite the outward projection.

5. The faucet spout assembly of claim 4 wherein the retainer is symmetrical.

6. The faucet spout assembly of claim 1 wherein the centerbody has an annular groove adjacent the recess to receive a portion of the retainer to assist in retainer positioning on the centerbody.

* * * * *